US005341948A

United States Patent [19]

Gaeta

[11] Patent Number: 5,341,948

[45] Date of Patent: Aug. 30, 1994

[54] TAMPER EVIDENT SEAL

[75] Inventor: Stephen A. Gaeta, Bloomfield, N.J.

[73] Assignee: CPC International Inc., Englewood Cliffs, N.J.

[21] Appl. No.: 894,492

[22] Filed: Jun. 5, 1992

[51] Int. Cl.[5] ..... B65D 41/00

[52] U.S. Cl. ..... 215/232; 215/305; 229/205

[58] Field of Search ..... 215/232, 295, 305; 220/257, 258, 359; 229/205, DIG. 5

[56] References Cited

U.S. PATENT DOCUMENTS 749,423 1/1904 Chapman .
2,016,936 10/1935 Waring .
2,077,985 4/1937 Bukolt .
3,392,901 7/1968 Krzyzanowski ..... 229/DIG. 5 X
3,620,438 11/1971 Wood et al. ..... 229/205
3,980,224 9/1976 Yasuda ..... 229/205
4,200,196 4/1980 Bashour ..... 215/253
4,555,037 11/1985 Rhees .

*Primary Examiner*—Allan N. Shoap
*Assistant Examiner*—Nova Stucker

[57] ABSTRACT

This invention relates to a tamper evident inner seal for use on bottles, jars and other types of containers. More specifically, this invention provides a means for rendering a heat or adhesive sealed liner tamper evident by enabling the liner to tear upon removal or opening, while providing a peelable seal that does not leave seal residuals attached to the container.

6 Claims, 2 Drawing Sheets

TAMPER EVIDENT SEAL

This invention relates to a tamper evident inner seal for use on bottles, jars and other types of containers. More specifically, this invention provides a means for rendering a heat or adhesive sealed liner tamper evident by enabling the liner to tear upon removal or opening, while providing a peelable seal that does not leave seal residual deposits attached to the container.

BACKGROUND OF THE INVENTION

A variety of "tamper proof", "tamper resistant" and "tamper evident" closures and seals have been disclosed and proposed for inhibiting improper or unauthorized opening of containers, or more importantly, to indicate to the ultimate consumer that such an opening has occurred. The main thrust behind this deluge of "tamper proof" or "tamper evident" closures is to protect consumers against third party tampering with the contents of the container, such as food or medicine, by placing them on notice or making it obvious to the consumers that such tampering may have occurred.

In U.S. Pat. No. 4,555,037 to Rhees, a tamper evident seal is disclosed and claimed. The seal includes a sheet of material secured over the opening of the container with the peripheral portions of the material extending downwardly about and adhering to the exterior of the side walls of neck.

In U.S. Pat. No. 2,016,936 to Waring, a re-seal type closure for a container is disclosed. The container closure comprises a re-seal cap and an inner disk seal, wherein a continuous uniform bond is formed within the edge of the material of the inner disk seal and the imperforate portion of this disk spans the mouth of the container. Application of a lifting stress to remove the disk from the top of the container results in the tearing of the disk to perforate or puncture the portion of the disk across the neck of the container.

In U.S. Pat. No. 4,200,196 to Bashour, a cap for a bottle is disclosed which has a top portion for covering the open mouth of the bottle and two spaced rings extending therefrom to define a groove to receive an annular lip portion of the bottle. One of the rings can be angled toward the other and be flexible such that the lip of the bottle is fully grasped and maintained in the groove. The radially outer ring of the cap is provided with a plurality of circumferentially spaced weakened areas so that when the cap is removed from the bottle the outer ring will tear at at least one of the weakened areas to identify when a cap has become unsealed from its bottle.

Numerous attempts have been made over the years to provide tamper evident closures for packages which provide the consumer with some degree of comfort. The presently claimed invention provides such comfort by incorporating a means to render a heat or adhesive sealed liner more tamper evident by enabling the liner to tear upon removal while providing a seal which, upon peeling, is totally removed from the container without leaving any seal residue which the consumer needs to remove prior to recycling of the container.

SUMMARY OF THE INVENTION

The present invention is related to a tamper evident, peelable seal for use on various containers such as bottles and jars. The seal comprises a sheet of directionally oriented material with a peripheral portion which has a plurality of "V-shaped" notches. The V-shaped notches are specifically designed so that one side of the V-shaped notch is cut on the perpendicular to the periphery of the seal. The unique combination of the V-shaped notches in directionally oriented material, in conjunction with the placement of the seal on the container provides for a means to render a heat or adhesive sealed liner tamper evident by enabling the liner to tear upon removal and also be fully peelable, so as not to leave any seal residue on the container.

DETAILS OF THE INVENTION

The present invention relates to a tamper evident seal which comprises a sheet of directionally oriented material with a peripheral portion having a plurality of V-shaped notches. The seal may be used on a variety of containers which are comprised of a hollow body for holding material, such as bottles or jars. The combination of the unique V-shaped notches in a directionally oriented material, in conjunction with the placement of the seal on the container, allows for a heat or adhesive sealed liner that tears upon removal and provides a fully peelable seal, which does not leave residual material on the container i.e., no sealant or foil remains on the surface of the lip of the container.

Figure 1:
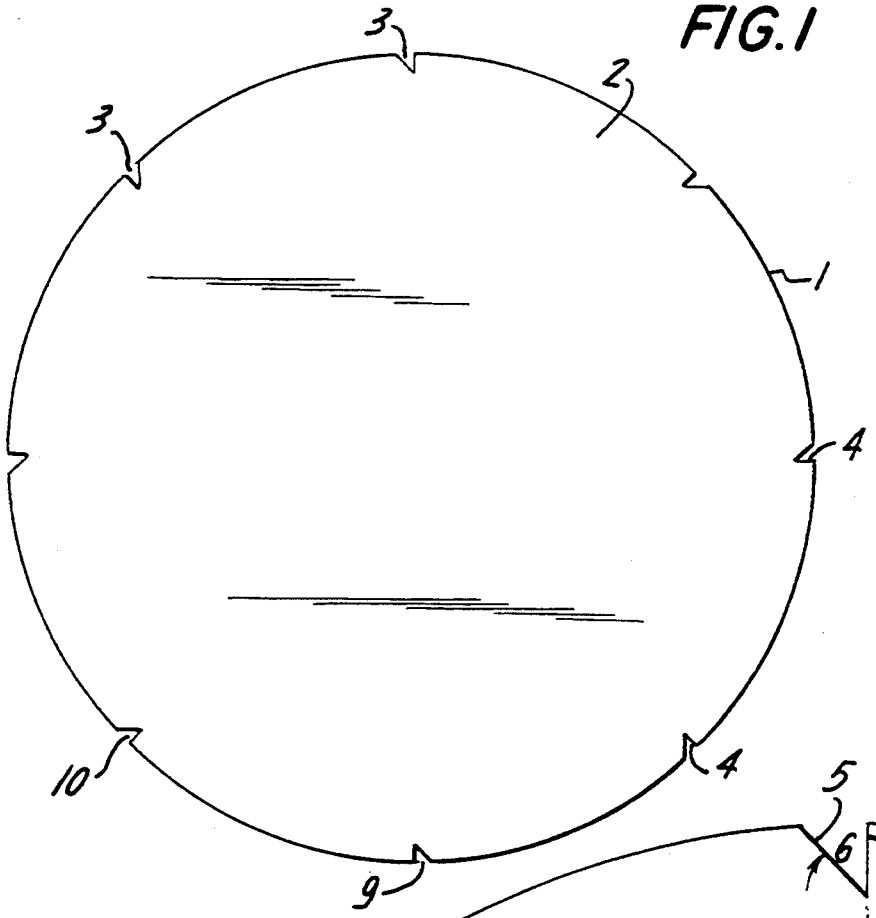
FIG. 1 is a top plan view of the tamper evident seal.
Figure 2:
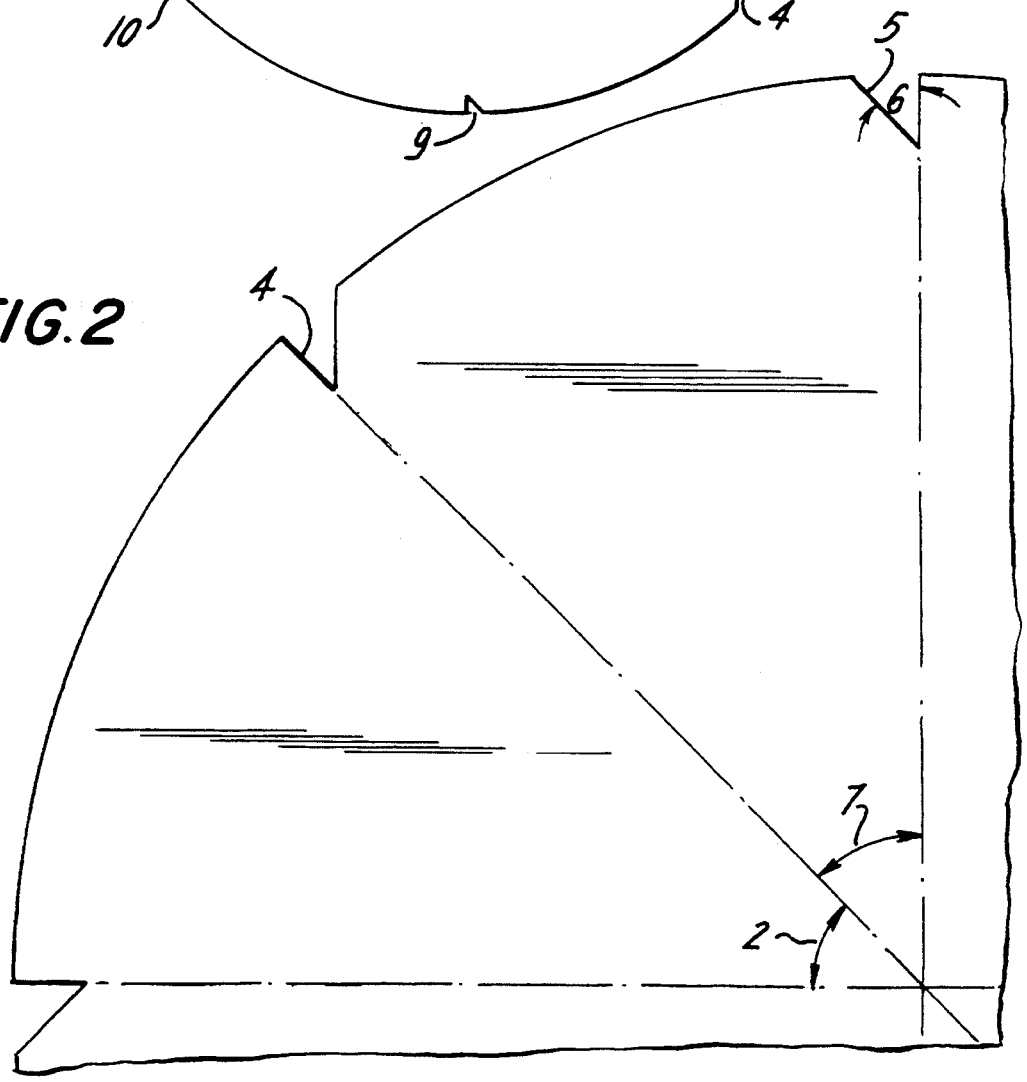
FIG. 2 is a detailed drawing which shows the angle of each V-shaped notch and the preferred angle between the notches.

Specifically, as shown in FIG. 1, the tamper evident seal (1) of the present invention comprises a sheet of directionally oriented material with the peripheral portion (2) having a plurality of V-shaped notches (3) FIG. 1. One side or edge of the V-shaped notch (4) is cut on the perpendicular to the periphery of the seal, i.e., the side of the notch with the edge of the seal forms a perpendicular or 90° angle. The second side of the V-shaped notch is then placed at an angle of from 40° to 50° from the perpendicular side, preferably 45° as shown in FIG. 2. The perpendicular side of the V-shaped notch is critical to the proper working of the present invention to allow for the proper tearing or mutilation of the seal when force is applied to remove the seal. The need for a perpendicular cut is directly related to the use of directionally oriented material, which can be defined as material which has a grain so that when pressure is applied, the material tears along or in the direction of the material grain.

In order to insure that a number of the perpendicular sides of the notches line up with or are co-directional with the grain of the material, the placement of the notches around the periphery is critical to the proper functioning of the tamper evident seal. The V-shaped notches are placed at specific set distances around the periphery of the seal. In a container with a round or circular opening, the optimum distance between the notches is 45° (7). If desired, it is possible to place the notches more closely together such as every 20° to 25° around the periphery, however the seal that is then formed with the container is not as strong as the optimum seal due to the increased number of non-contact points on the sealed periphery. Additionally, this may also impact the economics of producing the tamper evident As shown in FIG. 2, the V-shaped notches must be placed so that the perpendicular side (4) of each V-shaped notch alternates from notch to notch. Specifically, looking downwardly at the seal as FIG. 1, if one V-shaped notch (9) has the perpendicular side on the left then the notch (10) to its left should have the perpendicular cut on the right side of the notch so that the two perpendicular cuts can be described as being side by side on the seal. This placement of the notches helps to insure that at least one, if not more, of the perpendicular sides of the notches fall along or in the direction of the grain on the tamper evident seal.

The tamper evident seal can be comprised of a variety of materials, provided that they are directionally oriented materials. An example of such a directionally oriented material and the preferred embodiment of the present invention is a combination of foil, polyolefin and mylar. This material provides the necessary barrier to protect the contents of the container while simultaneously allowing for an induction seal. Other examples of suitable directionally oriented materials include polypropylene, polystyrene, cellophane or the like.

Figure 3:
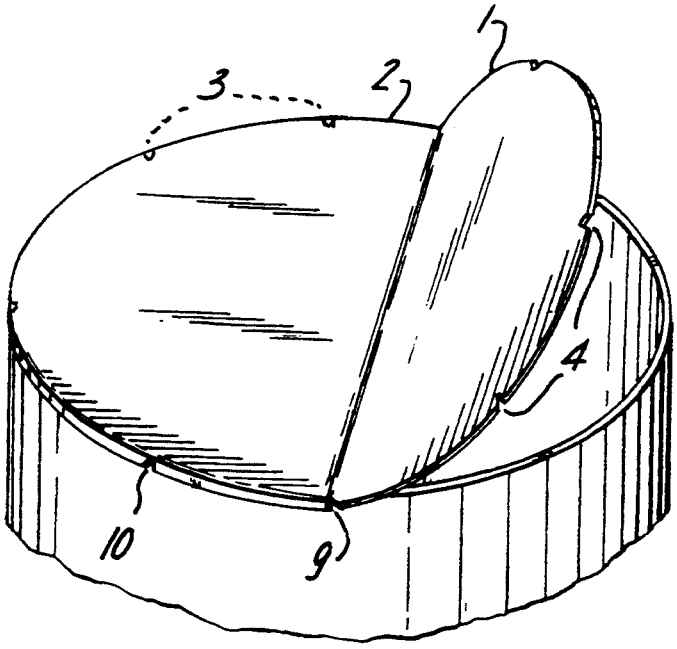
FIG. 3 is a perspective view of the tamper evident seal when it is partially adherred to a container.

The placement of the tamper evident seal on the container to be sealed is also critical to the proper performance of the seal (FIG. 3). The container (11) which is to be sealed can be any of a variety of containers provided it includes a hollow body (12) for holding material, a neck (13) at one end which extends from the body and terminates in a lip (14) which circumscribes an opening into which material is inserted and removed from the container. The container should also be comprised of a cap for placement over the opening onto the neck which covers the tamper evident seal, once it has been adhered to the container. Examples of containers which would benefit from this seal are glass or plastic bottles and jars which are used for holding food or pharmaceutical materials.

As shown in FIG. 3, the tamper evident seal is placed on the lip (14) of the container to be sealed. The seal is sized so that the outside circumference of the seal (2) is slightly larger than the outside circumference (15) of the lip of the container. The notches are cut so that the point or the tapered end just barely protrude into the sealing area and the tamper evident seal is adhered to the inside peripheral area of the lip (16) of the container. The sealing area is defined as that area of the lip of the container and that area of the tamper evident seal which come into direct contact with each other and which adhere to each other.

The optimal conditions, i.e., the optimal seal and the optimal peelability of the tamper evident seal occur when the tamper evident seal is adhered or sealed only to the inside periphery of the lip of the container, i.e., the tamper evident seal does not extend over the radii of the container. This critical placement of the seal in conjunction with the shape and placement of the notches on the seal provides for a unique tamper evident seal or liner in that the seal is easily peelable or removable from the container without leaving any adhesive or material residue on the container. This saves the ultimate consumer work in removing the seal and allows for easier recycling of the container.

While there has been shown and described what is considered to be the preferred embodiments of the invention, it will of course be understood that various modifications and changes in form or detail could readily be made without departing from the spirit of the invention. It is therefore intended that the invention be not limited to the exact form and detail herein shown and described, nor to anything less than the whole of the invention herein disclosed and as hereinafter claimed.

I claim:

1. A tamper evident seal comprising a sheet of directionally oriented material with the peripheral portion having a plurality of V-shaped notches each having two sides, wherein one side of the V-shaped notch is cut on the perpendicular to the periphery of the seal and the second side of the V-shaped notch is placed at an angle of from about 40° to about 50° from the perpendicular side, wherein the V-shaped notches are positioned so that the perpendicular side of the notch alternates from notch to notch.

2. The tamper evident seal of claim 1 which is circular in shape and wherein the V-shaped notches are spaced approximately every 45° around the periphery of the seal.

3. The tamper evident seal of claim 1 wherein the directionally oriented material comprises foil, polyolefin and mylar.

4. The tamper evident seal of claim 1, wherein the second side of the V-shaped notches is at a 45° angle to the perpendicular side.

5. A tamper evident seal for use on a container which includes a hollow body for holding material which has a neck at one end extending from the body to terminate in a lip and circumscribing an opening into which material is inserted and removed from the container and a cap for placement over the opening onto the neck, and wherein the seal comprises a sheet of directionally oriented material with a circular peripheral portion having a plurality of V-shaped notches comprising two sides wherein one side of the V-shaped notch is cut on the perpendicular to the periphery of the seal and the second side of the V-shaped notch is cut at an angle of 45° from the perpendicular cut, wherein the V-shaped notches are spaced approximately every 45° around the periphery of the seal and the perpendicular side of the V-shaped notches alternates from notch to notch.

6. The tamper evident seal of claim 5 wherein the radii of the seal is less than the radii of a container of intended use.

* * * * *